US009474123B2

(12) United States Patent
McGorty et al.

(10) Patent No.: US 9,474,123 B2
(45) Date of Patent: Oct. 18, 2016

(54) LED WATTAGE REDUCTION SYSTEM FOR FLUORESCENT LIGHT SYSTEM

(71) Applicants: Thomas Patrick McGorty, Shelton, CT (US); Kenneth Paul Schremmer, Shelton, CT (US)

(72) Inventors: Thomas Patrick McGorty, Shelton, CT (US); Kenneth Paul Schremmer, Shelton, CT (US)

(73) Assignees: Thomas P. McGorty, Shelton, CT (US); Kenneth P. Schremmer, Shelton, CT (US)

( * ) Notice: Subject to any disclaimer, the term of this patent is extended or adjusted under 35 U.S.C. 154(b) by 69 days.

(21) Appl. No.: 14/330,880

(22) Filed: Jul. 14, 2014

(65) Prior Publication Data

US 2015/0008824 A1 Jan. 8, 2015

Related U.S. Application Data

(60) Provisional application No. 61/804,705, filed on Jul. 2, 2013.

(51) Int. Cl.
*H05B 33/08* (2006.01)

(52) U.S. Cl.
CPC ..... *H05B 33/0854* (2013.01)

(58) Field of Classification Search
None
See application file for complete search history.

(56) References Cited

U.S. PATENT DOCUMENTS

2013/0257297 A1* 10/2013 Schmidt ..... H05B 35/00 315/182
2013/0278168 A1* 10/2013 Testani ..... G05F 3/04 315/250

* cited by examiner

*Primary Examiner* — Dedei K Hammond

(57) ABSTRACT

A system to reduce power consumption in a lighting fixture having one or more lamps is provided. The device includes a relay control module, a load control sensor, and a secondary light source. In certain embodiments, the invention includes a power supply to power the secondary light source. In a particularly useful embodiment, the system is retrofitted to standard fluorescent lighting fixtures and uses one or more light emitting diodes as the secondary light source. The system reduces the overall power consumption and attendant lighting costs by substituting a more energy efficient secondary lighting for the main lighting at times when full lighting is not necessary or desired.

5 Claims, 3 Drawing Sheets

LED WATTAGE REDUCTION SYSTEM FOR FLUORESCENT LIGHT SYSTEM

CROSS REFERENCE TO RELATED APPLICATIONS

This application claims the benefit of U.S. provisional application No. 61/804,705 filed on Jul. 15, 2013 entitled "LED Wattage Reduction System for Fluorescent Light Fixture". The entirety of that application is hereby incorporated by reference.

FIELD OF INVENTION

The field of the present invention generally relates to lighting systems and, more particularly, to systems that provide an alternative to a primary light source for use at night or under conditions that do not require or need full use of the primary light source.

BACKGROUND OF THE INVENTION

In light of the fact that fluorescent lighting provides up to 25% energy cost savings over incandescent bulbs, most office and warehouse environments are lit through the use of fluorescent lighting. Notwithstanding such savings, the power consumption of such lighting installations is significant because of their extensive coverage and prolonged use. Moreover, fluorescent lighting is not very amenable to flexible control, and can be difficult to dim and thus incapable of reducing power consumption during non-peak hours. Indeed, it is common practice to have designated fixtures that remain on at night after normal business hours (i.e., night lights) and all other room lights (i.e., the general lighting) have been turned off. The reduced number of lights that serve as night lights provide low level lighting for safety and security purposes. These designated night light fixtures therefore are on for twenty four hours a day, 365 days a year at full capacity. This not only wastes a tremendous amount of energy, it reduces the life of the ballasts and fluorescent bulbs and therefore increases the costs associated with providing lighting. Of possibly greatest concern, the discarded fluorescent bulbs necessarily contain mercury, which cannot be altogether eliminated from the bulbs. It is estimated that discarded fluorescent lamps release approximately 2 to 4 tons of mercury into the environment each year. (United States EPA Report on Fluorescent Lamp Recycling, February 2009, EPA530-R-09-001). Extending the life of fluorescent bulbs, even if just a portion of those that are used, would have the beneficial effect of reducing environmental mercury levels.

Fluorescent lights also have a relatively short lifetime and a high current draw as compared to some other types of lighting, and in particular in comparison with LEDs. Thus, retrofitting fluorescent lighting fixtures with LEDs or the like that provide night time light at a reduced power consumption using existing ballasts can help to relieve some of the above power and environmental problems by conserving energy (and the greenhouse gasses associated with generating that energy) and extending the life of the fluorescent bulbs without the significant cost of replacing all the current lighting fixtures present at a facility.

It would therefore be advantageous to provide a lighting system which overcomes one or more of the disadvantages or limitations of conventional fluorescent lighting systems by reducing power consumption and/or improving the life expectancy of the fluorescent bulbs and/or lighting ballast.

SUMMARY OF THE INVENTION

The following presents a brief summary of the innovation in order to provide a basic understanding of the aspects of the innovation. This summary is not an extended overview and is not intended to cover each and every element of the innovation or to limit its scope. A more detailed description is presented later.

In one embodiment, the light management system comprises a load control sensor that detects whether or not a monitored wire is carrying a load, a light source and a relay control module that directs power to the light source when the load control sensor does not detect a load in the monitored wire. In further embodiments, the invention further comprises a power supply that powers the light source. In yet another embodiment, the relay control module is a double pole double throw module; and in others, the light source comprises one or more light emitting diodes; and in others, the primary light source is a fluorescent light.

In an alternative embodiment, the light management system comprises a load control sensor that detects whether or not a monitored wire is carrying a load, a primary light source, a secondary light source, and a relay control module that directs power to the primary light source when the load control sensor detects a load in the monitored wire or, when the load control sensor does not detect a load in the monitored wire, to the secondary light source. The invention may also include a power supply that powers the secondary light source in another embodiment. In yet another embodiment, the relay control module is a double pole double throw module. In yet another embodiment the secondary light source comprises one or more light emitting diodes and in others, the primary light source is a fluorescent light.

The invention is also directed to a method of managing a light assembly comprising the steps of monitoring whether or not a load is present in a wire, providing information to a relay control module regarding whether or not a load is present in the wire, and routing power to a primary light source or a secondary light source. The methods claimed and described in this application may be used in operation of the light management assemblies described herein but may also be used with other systems.

Particular illustrations are described in connection with the following descriptions and the annexed drawings. These illustrations are indicative, however, of but a few of the various ways in which the principles of the innovation can be employed. Other advantages will be readily apparent from the detailed description that follows. The subject innovation is intended to include all aspects and equivalents.

BRIEF DESCRIPTION OF THE DRAWINGS

The accompanying drawing figures incorporated in and forming a part of this specification illustrate several aspects of the invention and together with the description serve to explain the principles of the invention.

DETAILED DESCRIPTION OF THE INVENTION

Figure 1:
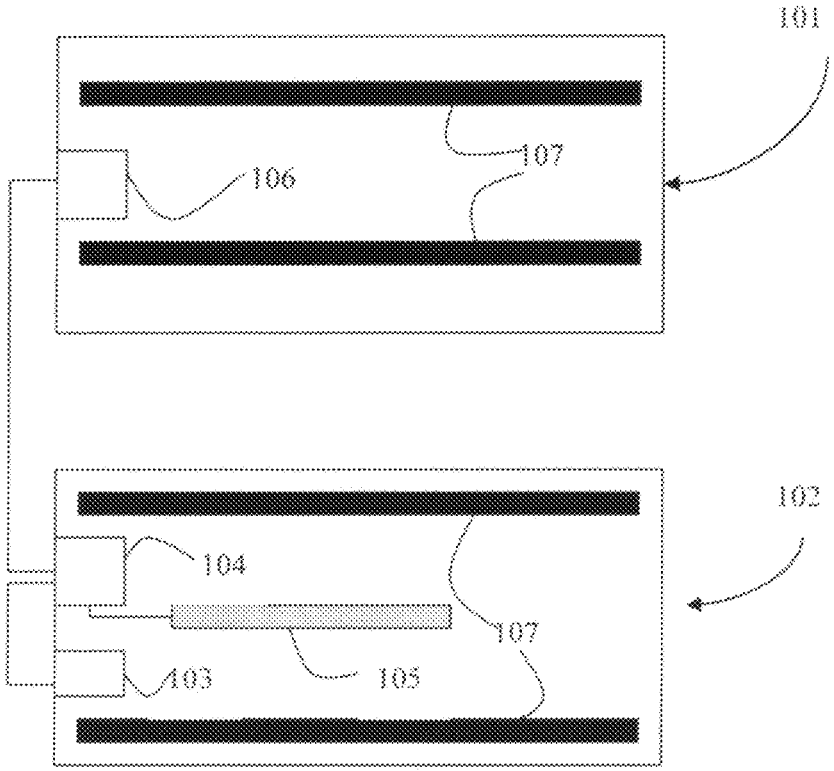
FIG. 1 is a pictorial representation of a night light and a general light incorporating one embodiment of the present invention.

The present invention can be better understood from the following description of preferred embodiments, taken in conjunction with the accompanying drawings. It should be apparent to those skilled in the art that the described embodiments of the present invention provided herein are merely exemplary and illustrative and not limiting.

The present invention is directed to novel and non-obvious systems and methods for managing lighting systems. Generally, the systems are used in conjunction with what are typically termed "night lights", i.e., those lights which are continuously illuminated for safety and security. In their simplest form, the light management systems of the invention comprise a load control sensor (LCS), a relay control module (RCM) and a light source that is used as an alternative to the primary light source of the light fixture. The terms, "alternative light source", "system light source" and "secondary light source" are used interchangeably in this application to refer to the lights that are powered by the system when a load is not detected on a monitored wire. The terms "primary light source" or "main light source" are used interchangeably in this application to refer to the lights that are powered during normal operation of the fixture. The terms "light" and "light source" are used interchangeably in this application. In another aspect of the invention, it may be advantageous to include a power supply that powers the secondary light source especially if the power provided to the light fixture must be converted to power the secondary lights.

In general, the system monitors whether or not a load is present in a monitored wire. The monitored wire is typically a wire that provides power to a general light, i.e., a light that is not used as a night light. This monitoring allows the system to determine whether or not a user desires to have the primary lights of the night light fixture illuminated (as indicated by the presence of a load on the monitored wire powering the general light) and to illuminate either the primary lights or the secondary lights. In various embodiments of the invention, the monitoring is conducted by the LCS of the system.

If the LCS detects a load, the RCM, to which the LCS is operatively connected, directs current to the ballast of the light fixture. In turn, current is provided to the primary lights which results in their illumination. If the LCS does not detect a load, the RCM directs current to the secondary lights, which results in their illumination. It will be understood by those of skill in the art that the system may be set up in various ways so that an open circuit results in power to the main lights and a closed circuit results in power to the secondary lights, or vice versa, without diverting from the scope of the invention. It should be understood that the primary lights will continue to be powered by the power provided to the light fixture and while the secondary lights may be powered by the same, in many instances and embodiments, the secondary lights will be powered by a power supply that is part of the light management system. The systems of the present invention are particularly well-suited for use with fluorescent lighting.

Although the invention is described in many aspects in relation to fluorescent lighting systems, and is particularly suited to use with fluorescent lighting, it should be understood that the current invention may be used with any type of light fixture. It should also be understood that although the continuously illuminated fixtures are referred to as "night lights" or "night lighting," the invention is not limited to night time use and may be used at any time that full illumination of the general lighting is not necessary or desired.

The secondary or alternative light source may be any type of lighting the user wishes to use as an alternative to the main or primary lighting in times when the main or primary lighting is not needed or desired and the secondary or alternative light source is not limited to any particular kind of light. However, the invention is particularly useful when the secondary light is a LED. As used in this application, "LED" may refer to both conventional high-brightness semiconductor light emitting diodes (LEDs) and organic light emitting diodes (OLEDs); semiconductor dies that produce light in response to current, light emitting polymers, electroluminescent strips (EL), etc. The use of "LED" also may refer to a single light-emitting device having multiple semiconductor dies that are individually controlled. It should also be understood that the use of "LED" does not restrict the package type of an LED. The use of "LED" may refer to packaged LEDs, non-packaged LEDs, surface mount LEDs, chip-on-board (COB) LEDs, and LEDs of all other configurations. The use of "LED" also includes LEDs packaged or associated with phosphor, wherein the phosphor may convert radiant energy emitted from the LED to a different wavelength of light. The use of "LED" will also include high-brightness white LEDs as well as high-brightness color LEDs in different packages. An LED array can consist of at least one LED or a plurality of LEDs, and at least one LED array can also consist of a plurality of LED arrays.

The RCM may take various forms in various embodiments of the invention so long as the RCM can direct power to alternative light sources based on information or signals (or a lack thereof) received by the RCM. In one embodiment, the relay control module is a double pole double throw (DPDT) relay. RCMs adequate for practicing the invention are available and known to those of skill in the art. For example, RCMs useful in practicing the invention are described in U.S. Pat. No. 3,711,728. In addition, RCMs suitable for practicing the invention are available from Altronix Corporation (Brooklyn, N.Y.) as model number RB524. In some embodiments, the RCM functions at direction of the LCS, which directs operation of the RCM depending on the load detected. However, in various other embodiments, the RCM may be controlled by timers, computer programs, dip switches, and the like.

The LCS may take various forms in different embodiments of the invention. The form of the LCS is not important as long as the LCS can detect the status of an electrical load across the monitored wire and provide information regarding the presence of absence of the electrical load. The LCS may take different forms based on what type of current is passing through the monitored wire. LCSs suitable for practicing the invention are known and readily available to those of skill in the ant and include, but are not limited to, the i-Snail-S transducer available from Elkor Technologies, Inc. (Ontario, Canada).

If present in a particular embodiment, the power supply may take a variety of forms as long as it is capable of receiving power from the main power supply and powering the secondary lights. In some instances, this includes converting the alternating current received from the main power supply to a direct current that can power the alternative lights. Such power supplies are known and readily available to those of skill in the art. For example, such power supplies may include off the shelf LED power supplies that are modified to be wired in parallel with the main power rather than plugged into a wall outlet. In certain cases, the power supply may convert 120V AC received from the main power supply to 24V DC or 12V DC that is used to power the secondary lights. Those skilled in the art would be able to substitute an appropriate power supply for alternative conversions as necessary for a specific application.

The light management systems of the present invention may significantly reduce energy expenditures. For example, it is estimated that, for a two fluorescent lamp fixture, energy consumption can be reduced from 64 watts to 4.4 watts using the present invention. For a three fluorescent lamp fixture, consumption can be reduced from 96 watts to 4.4 watts. That amounts to a savings of 59.6 watts for a two lamp fixture (93%) and 91.6 watts for a three lamp fixture (95%). In a typical office allowing for flextime and overtime, occupied time is about 72 hrs/wk, leaving 96 hrs unoccupied. For a two lamp fixture the annual kilowatt-hour savings would be 59.6 watts/1000 watts per Kw×96 hrs./wk×52 wks/yr=297.5 kwh per fixture.

FIG. 1 is a pictorial representation of the system of the present invention. This example shows a fluorescent fixture that acts as general lighting (a non-night light) 101 and a fluorescent fixture that acts as a night light 102, which, without the system of the present invention, has constantly illuminated fluorescent bulbs. A power supply 103, RCM 104 and a secondary or system light source 105 are affixed to the night light fixture 102. In the depicted embodiment the secondary light source 105 is an LED strip. Although depicted as separate components in this illustration, in some embodiments, the power supply 103 may be integrated with the RCM 104. In the depicted embodiment the power supply 103 and RCM 104 are installed in the ballast compartment of the light fixture. In other embodiments, however, the power supply 103 and RCM 104 may be mounted anywhere that permits the connections for control and operation of the system. In the depicted embodiment the alternative light source 105 is mounted on the surface of the night light fixture 102. However, the alternative light source may be mounted anywhere that permits illumination of the desired area, even if not present on the night light fixture. The method of installation or mounting of the power supply 103, RCM 104 and alternative light source 105 is not essential to the invention and may be accomplished by any means.

The LCS 106 detects whether or not a load is present in the wire that powers the general light 101. Although shown as mounted within the general light fixture 101, the LCS does not have to be on or near the general light fixture so long as the LCS can detect whether or not a load is passing through the wire powering the general light 101. The LCS 106 is operatively connected to the RCM 104 present on the night light fixture 102 so that the LCS 106 can provide a signal to the RCM 104. The presence or absence of a load across the general lighting power wire directs either operation of the fluorescent lights 107 of the night light fixture or the LED strip 105 of the night light fixture as described in this application.

Figure 2:
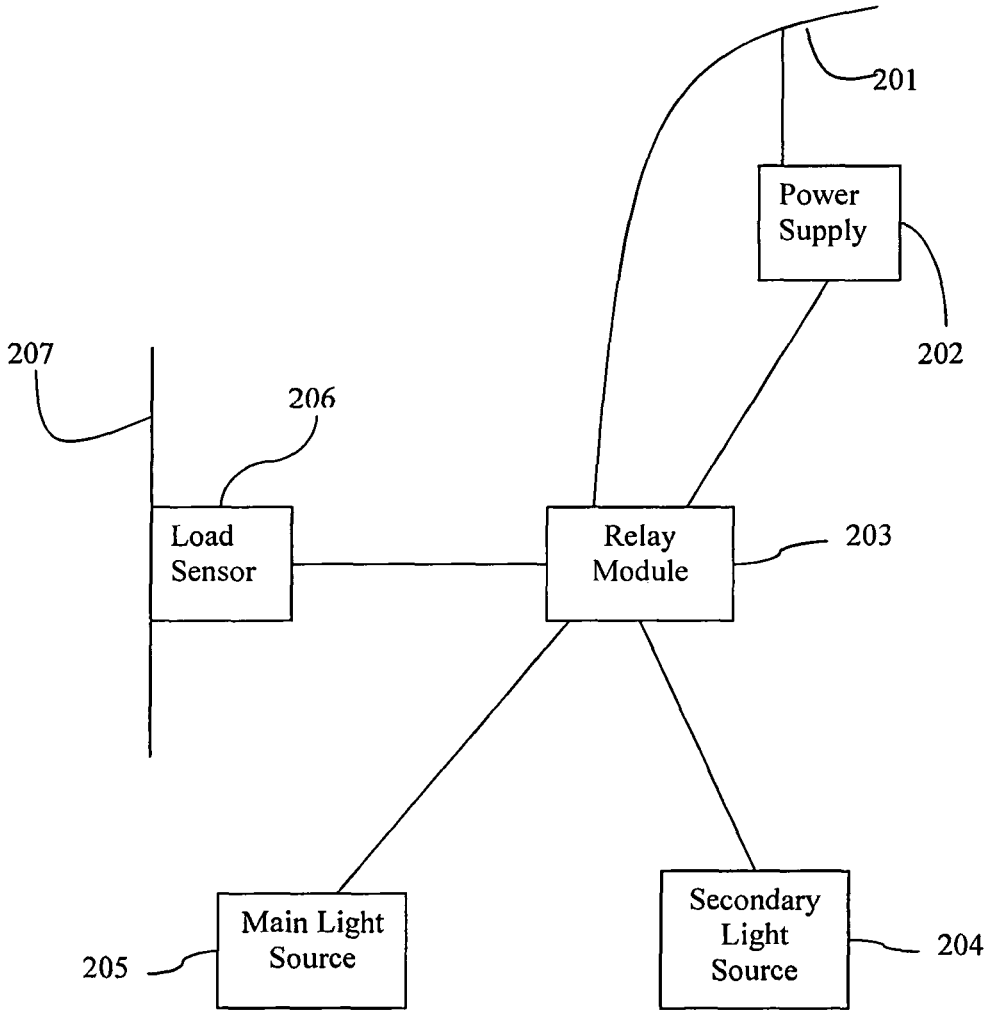
FIG. 2 shows a schematic block diagram of a representative embodiment of the light management assembly of the present invention.

FIG. 2 shows a schematic block diagram of a representative embodiment of the light management assembly of the present invention. The RCM 203 acts as hub of the system. The main power input 201 and power supply input 202 are connected in parallel to the RCM 203. Also connected to the RCM 203 are the outputs for powering the secondary light source 204 and primary light source 205 and inputs from the LCS 206. The main power input 201 and primary light source output 205 are connected to the RCM 203 so that the main power input 201 will provide power to the primary lights 205 of the night light fixture. The power supply input 202 and secondary light source output 204 are connected to the RCM 203 so that the power supply input 202 is connected to the secondary light source 204 through the RCM 203.

Referring still to FIG. 2, the depicted embodiment of the system also includes a LCS 206 which is operatively connected to the RCM 203 and provides instructions to the RCM 203 regarding which circuits within the RCM 203 should be closed or open based on the load state of a monitored wire 207. In the depicted embodiment, the monitored wire 207 is a wire that powers a general non-night fixture. However, the monitored wire can be any wire that carries a load and that the user wishes to use to determine whether or not the main lights of the night light fixture or the secondary light source of the night light fixture should be illuminated. Although in some embodiments the LCS 206 is depicted as present in the non-night light general light, such placement is not necessary and the LCS 206 need only be placed so that it can detect the presence or absence of a load in the monitored wire 207. This system permits powering the main lights 205 of the night light fixture without powering the secondary light source when a load is detected in the monitored wire 207 and powering of the secondary light source 204 without powering the main lights 205 of the night light fixture when no load is detected in the monitored wire.

Figure 3:
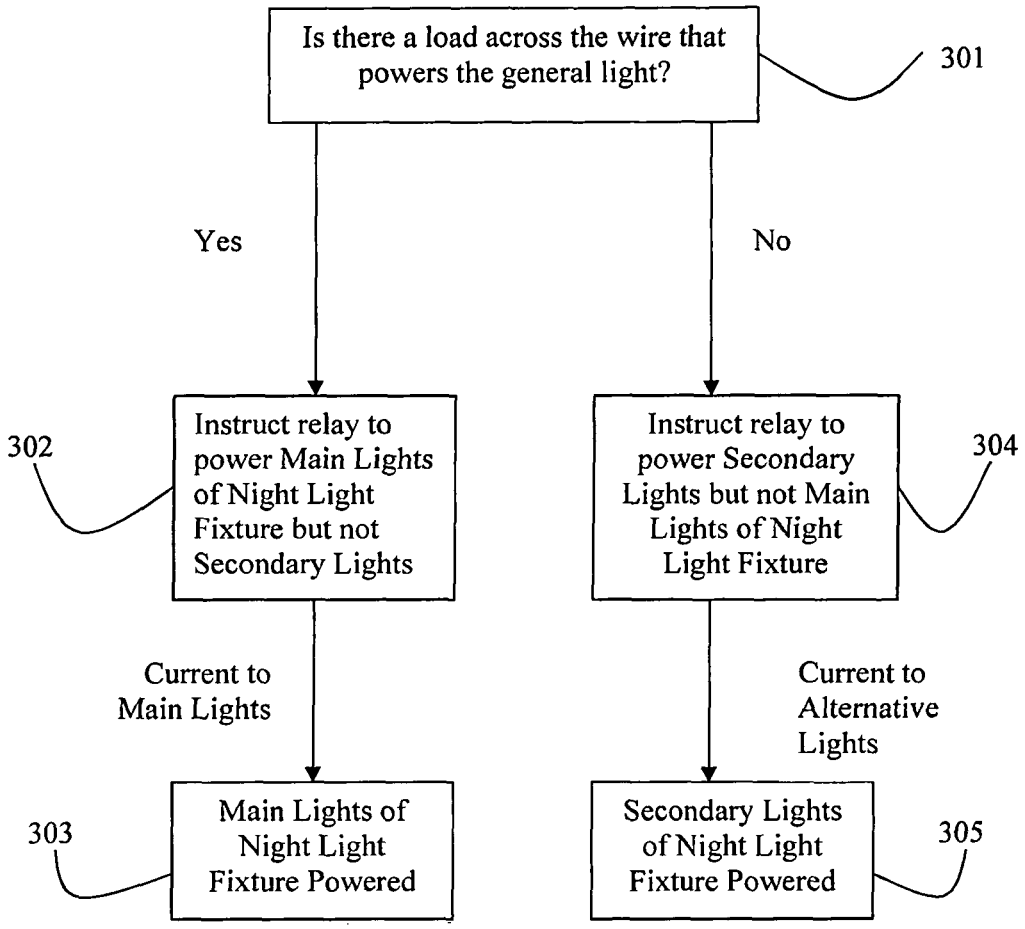
FIG. 3 is a block diagram outlining the steps that control the lighting process in accordance with a representative embodiment of the present invention.

FIG. 3 is a block diagram outlining the steps of a method that controls the lighting process in accordance with a representative embodiment of the present invention. In step 301, the power to a general non-night light is monitored for a load to determine whether or not the general non-night light is ON. If the system determines that the general non-night light is ON (i.e., there is a load across the wire), the system provides instruction to the RCM in step 302 to power the main lights in the night light fixture. In step 303, the main lights in the night light fixture are powered but not the secondary light source which results in illumination of the main lights of the night light fixture but not the secondary light source. Such instruction can be made simply by providing a signal to the RCM (or not providing a signal) which causes the RCM to close or open different circuits in response to the presence or lack of a signal from the LCS. If the system determines that the general non-night light is OFF (i.e., there is no load across the wire), the RCM in step 304 powers the secondary light source but not the main lights in the night light fixture. In step 305, the secondary light source is powered but not but not the main lights of the night light fixture which results in illumination of the secondary light source but not the main lights of the night light fixture.

All publications and patents cited in this specification are herein incorporated by reference in their entirety. Although the invention has been described in connection with specific preferred embodiments and certain working examples, it should be understood that the invention as claimed should not be unduly limited to such specific embodiments. Various modifications and variations of the described methods and systems of the invention will be apparent to those skilled in the art without departing from the scope and spirit of the invention.

What is claimed is:

1. A light management system comprising:

a fixture that is supplied by an un-switched constant feed alternating current main power circuit;

a primary light source in the fixture powered by an alternating current power supply;

a secondary light source;

a direct current power supply that powers the secondary light source but not the primary light source;

a load control sensor that monitors a wire supplying power to a switched general room lighting power circuit but not the fixture and detects whether the wire is carrying current;

a relay control module that directs power from the alternating current power supply to the primary light source in the fixture when the load control sensor detects current in the monitored wire by closing a circuit between the alternating current power supply and the primary light source and opening a circuit between the direct current power supply and the secondary light source or, when the load control sensor does not detect current in the monitored wire, directs power from the direct current power supply to the secondary light source, by closing the circuit between the direct current power supply and the secondary light source and opening the circuit between the alternating current power supply and the primary light source so that the secondary light source illuminates as a result of power provided by the direct current power supply.

2. The system of claim 1, wherein the secondary light source comprises one or more light emitting diodes.

3. The system of claim 1, wherein the relay control module is a double pole double throw module.

4. The system of claim 1 wherein the primary light source comprises one or more fluorescent lights and the secondary light source comprises one or more light emitting diodes.

5. A method of managing lighting comprising:

(a) providing a fixture that is supplied by an un-switched constant feed alternating current main power circuit;

(b) providing a primary light source in the fixture powered by the alternating current power supply;

(c) providing a direct current power supply that powers a secondary light source but not the primary light source;

(d) monitoring whether or not current is present in a wire powering a switched general room lighting circuit but not the fixture;

(e) providing information to a relay control module regarding whether or not current is present in the monitored wire;

(f) directing power from the alternating current power supply to the primary light source by having the relay control module close a circuit between the alternating current power supply and the primary light source and open a circuit between the direct current power supply and the secondary light source if current is detected in the monitored wire or, if no current is detected in the monitored wire, directing power from the direct current power supply to the secondary light source by having the relay control module close the circuit between the direct current power supply and the secondary light source and open the circuit between the alternating current power supply and the primary light source so that the secondary light source illuminates as a result of power provided by the direct current power supply.

* * * * *